US006698674B2

(12) United States Patent
Dantes et al.

(10) Patent No.: US 6,698,674 B2
(45) Date of Patent: Mar. 2, 2004

(54) FUEL INJECTOR VALVE

(75) Inventors: Guenter Dantes, Eberdingen (DE); Detlef Nowak, Untergruppenbach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/088,332

(22) PCT Filed: Jul. 13, 2001

(86) PCT No.: PCT/DE01/02540

§ 371 (c)(1),
(2), (4) Date: Jun. 19, 2002

(87) PCT Pub. No.: WO02/06663

PCT Pub. Date: Jan. 24, 2002

(65) Prior Publication Data

US 2002/0179748 A1 Dec. 5, 2002

(30) Foreign Application Priority Data

Jul. 15, 2000 (DE) ..... 100 34 446

(51) Int. Cl.[7] ..... B05B 1/30

(52) U.S. Cl. ..... 239/585.1; 239/585.5; 239/533.11; 239/533.12; 129/129.16

(58) Field of Search ..... 239/585.1–585.5, 239/533.2, 533.3, 533.11, 533.12; 251/129.16

(56) References Cited

U.S. PATENT DOCUMENTS

| | | | | |
|---|---|---|---|---|
| 4,151,958 A | | 5/1979 | Hofmann | |
| 4,202,500 A | * | 5/1980 | Keiczek | 239/533.3 |
| 4,215,821 A | * | 8/1980 | Eblen | 239/533.4 |
| 4,382,554 A | * | 5/1983 | Hofmann | 239/533.9 |
| 5,899,389 A | | 5/1999 | Pataki et al. | |
| 6,378,503 B1 | * | 4/2002 | Lambert | 239/533.12 |

FOREIGN PATENT DOCUMENTS

| | | |
|---|---|---|
| DE | 2711391 | 9/1978 |
| DE | 3540660 | 5/1987 |
| DE | 4023233 | 2/1991 |
| EP | 0337763 | 10/1989 |
| EP | 0692624 | 1/1996 |
| GB | 2150978 | 7/1985 |

* cited by examiner

*Primary Examiner*—Dinh Q. Nguyen
(74) *Attorney, Agent, or Firm*—Kenyon & Kenyon

(57) ABSTRACT

A fuel injector, in particular an injector for fuel injection systems of internal combustion engines, has a first actuator which cooperates with a first valve needle. A first valve closing body situated on the first valve needle cooperates with a first valve seat surface to form a first sealing seat. A second actuator cooperates with a second valve needle, and a valve-closing body situated on the second valve needle cooperates with a second valve seat surface to form a second sealing seat.

18 Claims, 2 Drawing Sheets

FUEL INJECTOR VALVE

FIELD OF THE INVENTION

The present invention relates to a fuel injector.

BACKGROUND INFORMATION

A fuel injector which has a valve needle operated by an actuator is already known. The actuator includes, for example, an electromagnetic coil or a piezoelectric element. An example of a fuel injector of this type is described in German Patent 35 40 660 C2. This fuel injector is capable of being actuated electromagnetically. The fuel injector has a valve housing containing a magnetic coil installed on a field spool. The valve needle combines with a valve-seat surface to form a sealing seat. The end of the valve needle facing the magnetic coil is permanently connected to an armature. Armature and valve needle are moved against the sealing seat by a restoring spring. If a voltage is applied to the magnetic coil, and a current subsequently flows through it, the armature is attracted to the force of the restoring spring by the magnetic field created and it lifts the valve needle off its sealing seat. The fuel can now exit through the injection bore downstream from the valve seat.

The disadvantage of this known fuel injector is the fact that the fuel distribution and quantity can only be controlled to a limited extent. The direction in which the fuel exits the fuel injector is determined by the orientation of the injection bore. An adaptation to various operational conditions, such as is necessary in the case of the lean-burn concepts and stratified-charge methods in combination with direct injection into the combustion chamber in particular, is very difficult or not possible at all.

From German Patent 40 23 233 A1 a fuel injector is known, which has, at its combustion-chamber end, two hole circles made up of injection bores. In order to be able to separately control the two hole circles, the fuel injector has two coaxial valve needles in one nozzle body. In the region of the combustion-chamber side end sections of the two valve needles, there is also a separating sleeve installed between the two valve needles, whose end face cooperates with one valve seat surface, common to the valve seat surfaces of the two valve needles. The two hole circles are supplied with fuel—along the valve needles—by individual fuel intakes, with each of the two fuel intakes having its own fuel injection pump. This makes it possible to configure the flow rate and orientation of the injection bores of the two hole circles differently from one another and, therefore, control the direction and quantity of fuel injection to a certain degree by triggering the two valve needles separately. The disadvantage, however, is the overall multicomponent design, since three high-precision components—the two valve needles and the separating sleeve—must be manufactured in such a way as to ensure the most precise fit possible, and the fact that it is necessary to provide two fuel injection pumps, or one fuel injection pump doing double duty for each fuel injector. This results in additional costs. Another disadvantage is that there are a total of three sealing seats—one for the first valve needle, second for the second valve needle, and third for the separating sleeve. Furthermore, it is also disadvantageous that triggering occurs purely hydraulically, and no individual regulation based on a characteristic map is possible to the extent possible, in the case of a fuel injector controlled by an actuator.

From published German Patent Application 27 11 391 A1 a fuel injector is known that has two valve needles. Both valve needles are acted upon in the closing direction by one spring each and cooperate with one valve seat surface each to form a sealing seat. Different injection orifices are opened by the two valve needles. Control of the valve needles is purely hydraulic, with the opening sequence being determined by the varying spring force of the two valve needle closing springs. An adaptation to performance data of an internal combustion engine—as is typically possible with an actuator-controlled fuel injector—is therefore not feasible.

SUMMARY OF THE INVENTION

The fuel injector according to the present invention has the advantage over the related art that a fuel distribution in the combustion chamber is possible, which adapts to the requirements of the characteristics map and especially to a lean-burn concept.

In particular, the angle under which the fuel is distributed in the spray pattern of the fuel injector, is changeable. This is possible with the fuel injector according to the present invention due to the design using two valve needles, each of which is operated by its own actuator. Moreover, actuation via one actuator at a time, makes the fuel injector easily adaptable to a characteristics map of the internal combustion engine.

With this invention it is possible to actuate two different hole circles containing injection bores by the two sealing seats of the two valve needles in an advantageous manner.

The injection bores of the different hole circles may have, in particular, different injection angles and be offset against each other. This is also advantageous since, in the case of a small injection quantity and engine load, it is possible to initially actuate only one valve needle, so that a first hole circle is opened. This invention also has, for example, a narrow injection angle of the injection bores, so that a fuel injector jet, made up of the fuel jets of the individual injection bores, is formed having an overall narrow angle range. At a higher load of the internal combustion engine and corresponding demands, during stratified-charge operation, of an internal combustion engine using the lean-burn concept, the second valve needle is lifted off the sealing seat as well. This now also opens up the second hole circle of injection bores. These bores may have a larger injection angle. Thus with this invention the total spray of fuel injected is supplied in a greater angular range.

DETAILED DESCRIPTION

Figure 1:
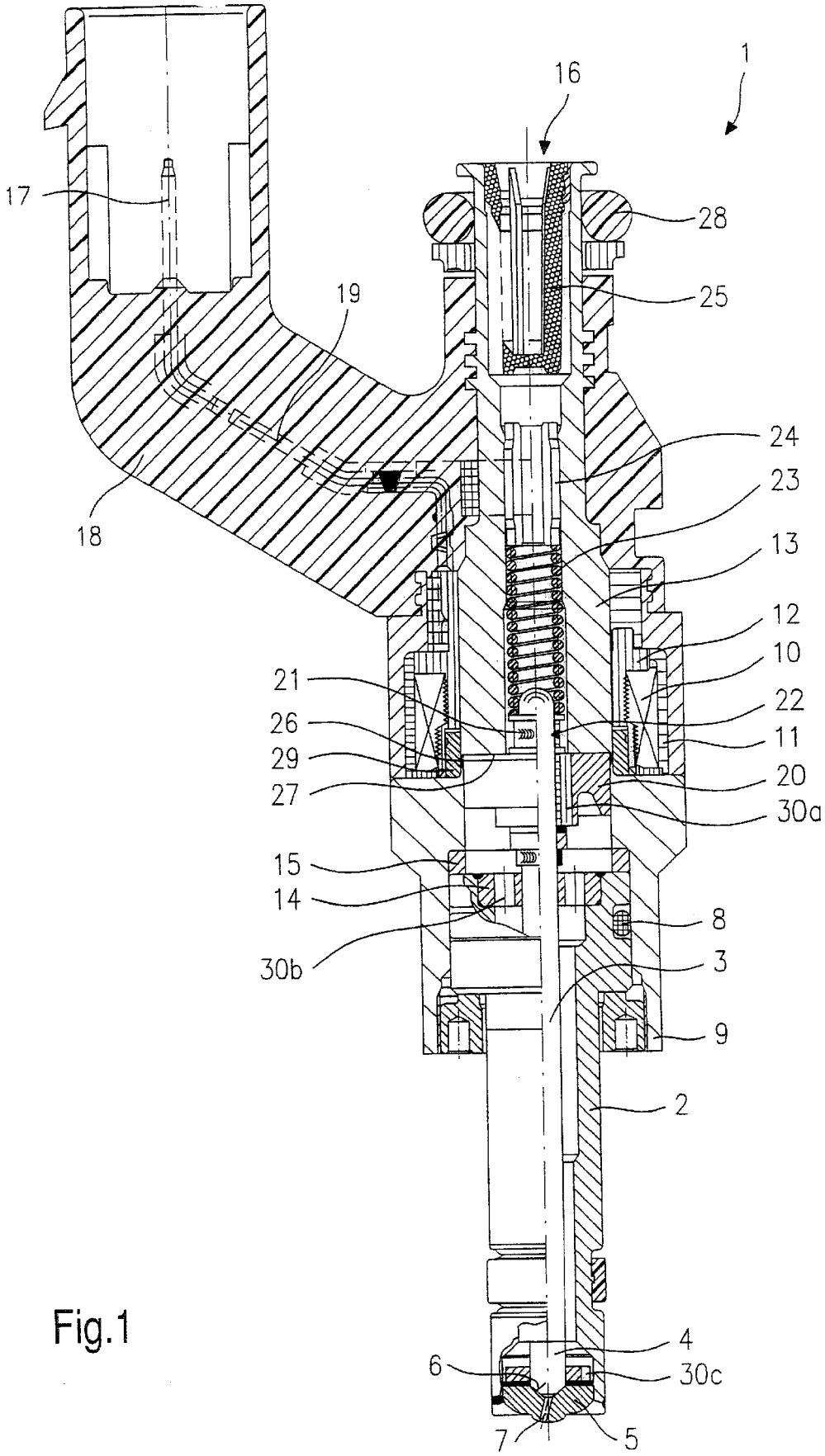
FIG. 1 shows a section through a generic fuel injector having an actuator-operated valve needle.
Figure 2:
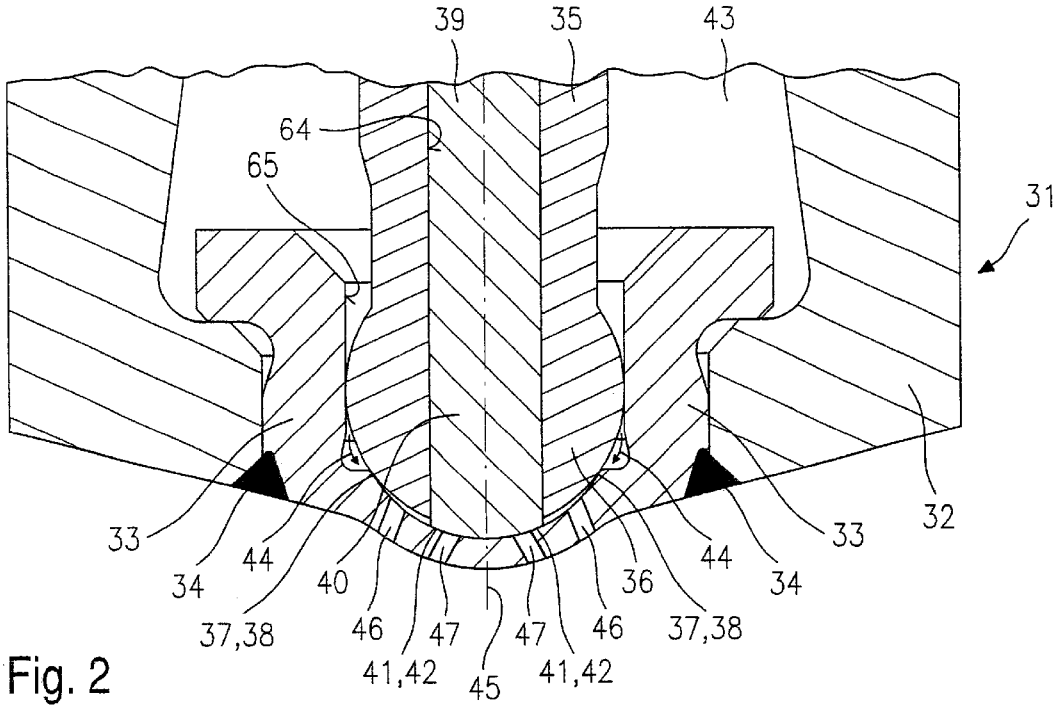
FIG. 2 shows a detail cutaway view of a first embodiment of a fuel injector according to the present invention.
Figure 3:
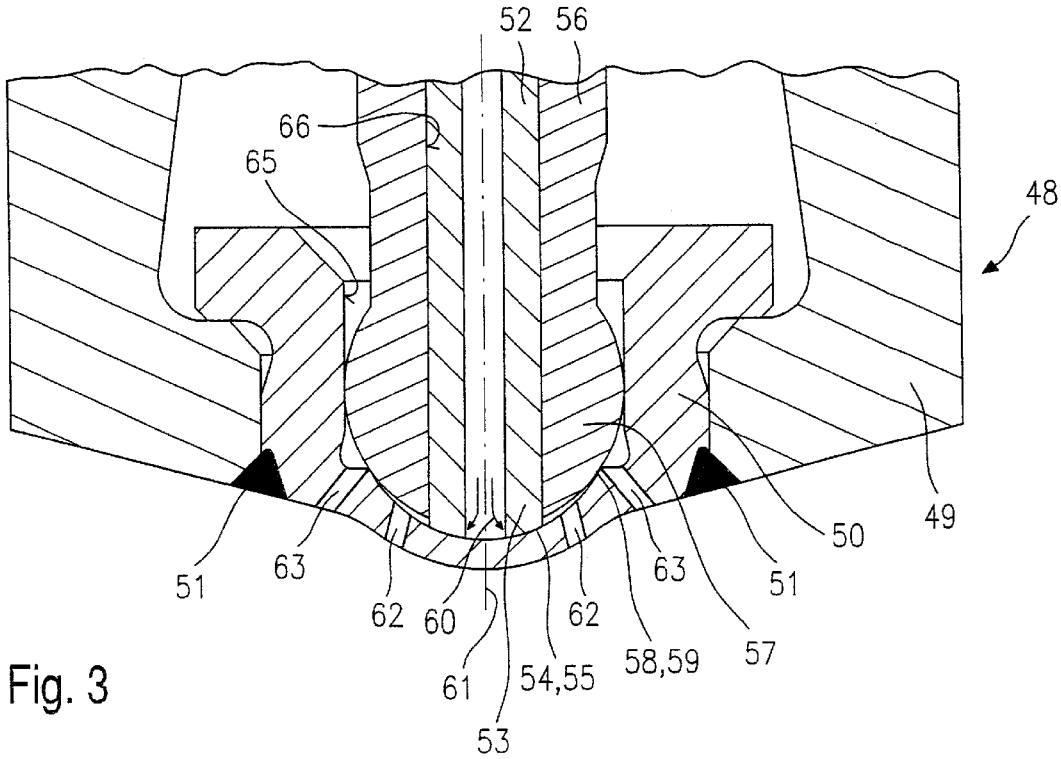
FIG. 3 shows a detail cutaway view of a second embodiment of a fuel injector according to the present invention.

Before describing two embodiments of a generic fuel injector in more detail, based on FIGS. 2 and 3, an already-known fuel injector, serving as an example of a fuel injector having an actuator, is briefly explained regarding its essential components, using FIG. 1.

Fuel injector 1 is configured as a fuel injector for fuel injection systems of mixture-compressing, externally-ignited internal combustion engines. Fuel injector 1 is suited in particular for direct injection of fuel into a combustion chamber (not shown) of an internal combustion engine.

Fuel injector 1 has a nozzle body 2, which guides a valve needle 3. Valve needle 3 is mechanically linked to a valve closing body 4, which cooperates with a valve seat surface 6 situated on a valve seat body 5, to form a sealing seat. Fuel injector 1 in the example of this embodiment is a fuel injector 1 opening toward the inside and having an injection bore 7. Nozzle body 2 is sealed against stationary pole 9 of a magnetic coil 10 (which acts as an actuator here) by seal 8. Magnetic coil 10 is encapsulated in a coil housing 11 and wound onto a field spool 12 adjacent to an internal pole 13 of magnetic coil 10. Internal pole 13 and stationary pole 9 are separated by a clearance 26 and are supported by a connecting component 29. Magnetic coil 10 is energized via line 19 by an electric current feedable via an electric plug-in contact 17. Plug-in contact 17 is enclosed by a plastic sheathing 18, which may be sprayed onto internal pole 13.

Valve needle 3 is situated in a valve needle guide 14 configured as a disk. Lift adjustment is carried out by paired adjusting disk 15. On the other side of adjusting disk 15 is armature 20. This is connected in a friction-locked manner via flange 21 to valve needle 3, which is connected to flange 21 via weld 22. Flange 21 supports a restoring spring 23 which, in the present design of fuel injector 1, is preloaded by a sleeve 24. Valve needle guide 14, armature 20, and valve seat body 5 contain fuel channels 30*a* through 30*c*, which direct the fuel, which is supplied via a central fuel feed 16 and filtered by filter element 25, to injection bore 7. Fuel injector 1 is sealed by seal 28 against a cylinder head (not shown in detail) or a fuel distributor.

In the rest state of fuel injector 1, armature 20 is acted upon by restoring spring 23 against its lift direction in such a way that valve closing body 4 is held tightly on valve seat 6. When magnetic coil 10 is energized, it builds up a magnetic field that moves armature 20 against the force of restoring spring 23 in the direction of lift, with the lift being defined by working clearance 27 at rest between internal pole 12 and armature 20. Armature 20 takes along flange 21, welded to valve needle 3, also in lift direction. Valve closing body 4, which is mechanically linked to valve needle 3, lifts off the valve seat surface, and fuel is supplied via injection bore 7.

When the coil current is turned off, armature 20, after sufficient reduction of the magnetic field, drops off the internal pole 13 due to the pressure of restoring spring 23, thus causing flange 21, which is mechanically linked to valve needle 3, to move against the direction of the lift. This also moves the valve needle 3 in the same direction, thus causing the valve closing body 4 to rest on valve seat surface 6 and fuel injector 1 to close.

FIG. 2 shows the combustion chamber side segment of a fuel injector 31 according to the present invention, along with the lower segment of a valve body 32. A valve seat body 33 is connected to valve body 32 via a circumferential weld 34. A first valve needle 35 which, in the embodiment presented here, is connected to a valve closing body 36 in one piece and configured as a hollow cylinder, acts together with a valve seat surface 37 to form an outer sealing seat 38. A second solid valve needle 39 which, in its segment facing the combustion chamber, is also configured as a one-piece valve closing body 40, cooperates with a second valve seat surface 41, which in turn is formed in valve seat body 33, to form a second inner sealing seat 42. Second valve needle 39 is situated in an inner longitudinal opening 64 of the first valve needle 35.

Valve seat body 33 has an inner guide opening 65, in which first valve needle 35 and its valve closing body 36 are guided. Adjacent to a fuel chamber 43, outside of the first valve needle 35 and its valve closing body 36—in relation to center axis 45—is a fuel inlet 44 (indicated here by an arrow) to first or outer sealing seat 38. This fuel inlet 44 is created, for example, by bevels at the outer circumference of valve closing body 36, so that the fuel in the inner guide opening 65 is able to flow downstream. A first outer hole circle 46 of injection bores is situated in valve seat body 33. A second inner hole circle 47 of injection bores is also situated in valve seat body 33. In the embodiment selected here, the injection bores of first hole circle 46 have a smaller angle relative to center axis 45 than the injection bores of second hole circle 47. The injection bores of both hole circles 46, 47 may be offset by a circumferential angle (not visible in the representation selected here), so that the fuel jet of one injection bore sprays into the space between two injection bores of the other hole circle.

First hole circle 46 is situated within first or outer sealing seat 38 in relation to center axis 45. Accordingly, second hole circle 47 is situated within second sealing seat 42 in relation to center axis 45. When both valve needles 35, 39 along with their valve-closing bodies 36, 40 rest on their respective sealing seats 38, 42, hole circles 46, 47 are sealed off from fuel inlet 44. When first valve needle 35 and its valve-closing body 36 are lifted off their first sealing seat 38, a connection between fuel inlet 44 and first hole circle 46 is established.

The injection bores of first hole circle 46 have a smaller angle in relation to center axis 45. This creates, in the combustion chamber, a narrow fuel injection jet, which widens under a narrow angle. Second hole circle 47 is separated from fuel inlet 44 by a second valve needle 39 having second valve closing body 40, which still rests on second sealing seat 42, separated from fuel inlet 44. Should a further widening fuel injection jet be desired, second valve needle 39 with its valve closing body 40 may be lifted from its second sealing seat 42 by a second actuator, which is not shown here. This opens up a connection from fuel inlet 44 and finally from fuel chamber 43 to second hole circle 47 as well. The fuel injection jet is now supplemented by the fuel that is injected through the injection bores of second hole circle 47 under a wider angle in relation to center axis 45, which results in a widening of the fuel injection jet.

FIG. 3 shows an alternative embodiment according to the present invention in a cutaway view of the segment of fuel injector 48 facing the combustion chamber. A valve seat body 50 is situated in a valve body 49 and connected to it by a weld 51. Weld 51, for example extends in a circle around center axis 61.

A first hollow cylindrical valve needle 52, whose segment facing the combustion chamber is configured as one-piece valve closing body 53, cooperates with a first valve seat surface 54, situated in valve seat body 50, to form a first inner sealing seat 55. A second hollow cylindrical valve needle 56, whose segment facing the combustion chamber is configured as one-piece valve closing body 57, cooperates with a second valve seat surface 58 of valve seat body 50 to form a second outer sealing seat 59. In contrast to the embodiment shown in FIG. 2, the designations of first and second valve needle are reversed in the case of the embodiment shown here. Second valve needle 56 has an inner longitudinal opening 66 which houses first valve needle 52.

In this embodiment, the fuel reaches the first inner sealing seat 55 through fuel feed or inlet 60, configured as inner bore of first valve needle 52, instead of through outer fuel inlet 44. The inflow of the fuel is indicated by arrow in fuel feed 60. A first inner hole circle 62 of injection bores is situated outside of first sealing seat 55 in valve seat body 50, in relation to center axis 61. A second outer hole circle 63 of injection bores is situated outside of second sealing seat 59, in relation to center axis 61. First sealing seat 55 seals off first hole circle 62 from fuel feed 60, and first sealing seat 55 as well as second sealing seat 59 seal off second hole circle 63 and its injection bores from fuel feed 60. The designations of the two hole circles as first hole circle 62 and second hole circle 63 are also reversed compared to the respective hole circles in FIG. 2.

As already described in FIG. 2, first hole circle 62 is connected, accordingly, to fuel feed 60, when first valve needle 52 along with its valve closing body 53 is lifted off first sealing seat 55. A fuel injection jet is injected into the combustion chamber (not shown here). The fuel injection jet is configured depending on the angle and placement of the injection bores of first hole circle 62. Should a different configuration of the fuel injection jet be required to correspond to a certain operating point in the characteristics map of the internal combustion engine, second valve needle 56, which is completely independently triggerable by an actuator (not shown here), can additionally be lifted, together with its valve closing body 57, off second sealing seat 59 and open up fuel feed 60 to second hole circle 63.

The angular orientation and placement of the injection bores of first hole circle 62 and second hole circle 63 are only used as examples in the embodiment shown here in FIG. 3 and, correspondingly, in the embodiment in FIG. 2.

What is claimed is:

1. A fuel injector for fuel injection systems of an internal combustion engine, comprising:

a first valve needle;

a first actuator which cooperates with the first valve needle;

a first valve seat surface;

a first valve-closing body situated on the first valve needle, said first valve-closing body cooperating with the first valve seat surface to form a first sealing seat;

a second valve needle;

a second actuator which cooperates with the second valve needle;

a second valve seat surface; and a second valve-closing body situated on the second valve needle, said second valve-closing body cooperating with the second valve seat surface to form a second sealing seats;

wherein the first actuator and the second actuator are magnetic coils which are electrically operated.

2. The fuel injector according to claim 1, wherein at least one of the valve needles is configured as a hollow needle which surrounds and guides the other valve needle.

3. The fuel injector according to claim 2, wherein the valve needles are arranged coaxially.

4. The fuel injector according to claim 2, further comprising a valve seat body which has a first circumferential hole circle having a plurality of injection bores so that the first sealing seat seals off the first circumferential hole circle from a fuel inlet.

5. The fuel injector according to claim 4, wherein the valve seat body has a second circumferential hole circle having a plurality of injection bores so that the first sealing seat and the second sealing seat seal off the second circumferential hole circle from the fuel inlet.

6. The fuel injector according to claim 5, wherein the first valve needle is the hollow needle, and the fuel inlet is situated circumferentially outside the first valve needle, and the first circumferential hole circle is situated between the first sealing seat and the second sealing seat in the valve seat body, and the second circumferential hole circle is situated within the second sealing seat toward a center axis of the fuel injector.

7. The fuel injector according to claim 5, wherein the first and the second valve needles are hollow needles, and the first valve needle and the first valve closing body have an inner bore facing the first sealing seat, and wherein a fuel feed takes place through this inner bore which is used as a fuel inlet, and wherein the first circumferential hole circle is situated between the first sealing seat and the second sealing seat in the valve seat body, and the second circumferential hole circle is situated outside the second sealing seat towards a center axis of the fuel injector.

8. The fuel injector according to claim 5, wherein the injection bores of the first circumferential hole circle and the injection bores of the second circumferential hole circle have different injection angles.

9. The fuel injector according to claim 5, wherein the injection bores of the first circumferential hole circle are offset from the injection bores of the second circumferential hole circle by a circumferential angle.

10. The fuel injector according to claim 1, wherein at least one of a combination of the first valve needle and the first valve-closing body and a combination of the second valve needle and the second valve closing body is configured as one piece.

11. The fuel injector according to claim 1, wherein:

at least one of the valve needles is configured as a hollow needle which surrounds and guides the other valve needle, and the valve needles are arranged coaxially.

12. The fuel injector according to claim 11, further comprising a valve seat body which has a first circumferential hole circle having a plurality of injection bores so that the first sealing seat seals off the first circumferential hole circle from a fuel inlet.

13. The fuel injector according to claim 12, wherein the valve seat body has a second circumferential hole circle having a plurality of injection bores so that the first sealing seat and the second sealing seat seal off the second circumferential hole circle from the fuel inlet.

14. The fuel injector according to claim 13, wherein the first valve needle is the hollow needle, and the fuel inlet is situated circumferentially outside the first valve needle, and the first circumferential hole circle is situated between the first sealing seat and the second sealing seat in the valve seat body, and the second circumferential hole circle is situated within the second sealing seat toward a center axis of the fuel injector.

15. The fuel injector according to claim 13, wherein the injection bores of the first circumferential hole circle and the injection bores of the second circumferential hole circle have different injection angles.

16. The fuel injector according to claim 13, wherein the injection bores of the first circumferential hole circle are offset from the injection bores of the second circumferential hole circle by a circumferential angle.

17. The fuel injector according to claim 13, wherein at least one of a combination of the first valve needle and the first valve-closing body and a combination of the second valve needle and the second valve closing body is configured as one piece.

18. The fuel injector according to claim 11, wherein at least one of a combination of the first valve needle and the first valve-closing body and a combination of the second valve needle and the second valve closing body is configured as one piece.

* * * * *